US005131878A

United States Patent [19]

Choi

[11] Patent Number: 5,131,878

[45] Date of Patent: Jul. 21, 1992

[54] PROCESS FOR MANUFACTURING DISPENSER CATHODE

[75] Inventor: Jong S. Choi, Seoul, Rep. of Korea

[73] Assignee: Samsung Electron Devices Co., Ltd., Kyungki, Rep. of Korea

[21] Appl. No.: 761,298

[22] Filed: Sep. 17, 1991

[30] Foreign Application Priority Data

Sep. 22, 1990 [KR] Rep. of Korea ..... 90-15090

[51] Int. Cl.[5] ..... H01J 9/04; H01J 1/94

[52] U.S. Cl. ..... 445/29; 445/36; 313/270; 313/346 DC

[58] Field of Search ..... 445/50, 51, 29, 36; 313/270, 346 DC

[56] References Cited

U.S. PATENT DOCUMENTS 2,912,611 11/1959 Beck et al. ..... 445/50
3,914,638 10/1975 Collins et al. ..... 313/270
4,246,682 1/1981 Davis ..... 445/29 X
4,833,361 5/1989 Suzuki ..... 313/346 DC

*Primary Examiner*—Kenneth J. Ramsey
*Attorney, Agent, or Firm*—Ladas & Parry

[57] ABSTRACT

A process for manufacturing a dispenser cathode is disclosed, and the process comprises the steps of filling a porous base material into a storage tank, welding the storage tank to a cylindrical sleeve, installing a heater into the sleeve which has, a supporting face to be welded with the storage tank, an outside diameter which is larger than that of the storage tank, and an opening which is smaller than the outside diameter of the storage tank, wherein the heat transfer to the porous base material during the welding is prevented and the thermal efficiency is improved during the operation of the cathode so that a superior cathode characteristic is achieved.

3 Claims, 2 Drawing Sheets

PROCESS FOR MANUFACTURING DISPENSER CATHODE

FIELD OF THE INVENTION

The present invention relates to an electron gun for a barium tube, an image tube and the like, and more particularly to, a process for manufacturing a dispenser cathode of high current density.

BACKGROUND OF THE INVENTION

The dispenser cathode which is the typical one among barious cathodes is constituted by impregnating an electron emitting material such as barium aluminate and the like into the pores of a porous base material having high melting point such as tungsten, molybdenum and the like, and such a cathode has a superior electron emitting capability and a longer life expectancy in compared with the conventional ternary-carbonate cathode.

Therefore, such a dispenser cathode can be advantageously applied to a large braun tube or a high resolution braun tube. It has problems, however, that its assembling process and the manufacturing process are such complicated and its electron emitting characteristic is unstable.

FIG. 1 is a partial cross-sectional view of a conventional dispenser cathode. In FIG. 1, a porous metal base material 2, into which an electron emitting material is impregnated, is disposed in a storage tank 3 and the storage tank 3 is attached to a closed top of a cylindrical sleeve 1, where the outside diameter of the storage tank 3 is smaller than that of the cylindrical sleeve 1.

In such a dispenser cathode, since the storage tank 3 and the cylindrical sleeve 1 are overlapped together, thermal transfer during the heating of the heater can not be performed smoothly, thereby lowering the cathode efficiency. Further, when the storage tank 3 which is filled with the same material 2 and the cylindrical sleeve 1 are welded together by a jig, the electron emitting material impregnated into the base material 2 is evaporated or deteriorated by its welding heat, thereby lowering the cathode efficiency.

FIG. 2 illustrates another type of the conventional dispenser cathode. In FIG. 2, the storage tank 3 which is filled with a porous base material 2 such as tungsten is weld-fixed to an open top of cylindrical sleeve 1. In this dispenser cathode, since the storage tank 3 and the sleeve 1 are directly welded together at the edges thereof into an integral body, the electron emitting material impregnated into the base material 2 is evaporated or deteriorated by the welding heat thereby lowering the cathode efficiency. Further, when the storage tank 3 and the sleeve 1 are not contacted substantially such a welding defect can cause a distortion or make a hole.

SUMMARY OF THE INVENTION

The present invention is intended to overcome the above described disadvantages of the conventional techniques.

Therefore, it is an object of the present invention to provide a process for manufacturing a dispenser cathode which has a superior cathode characteristic in its thermal efficiency and its quick operation.

It is another object of the present invention to provide a process for manufacturing a dispenser cathode, in which the evaporation and degradation of the electron emitting material can be efficiently prevented.

It is still another object of the present invention to provide a process for manufacturing a dispenser cathode, in which the defect factor can be eliminated during the welding and the assembling and the welding process is simple as to apply to mass productions.

In order to achieve the above objects, the process for manufacturing a dispenser cathode according to the present invention uses a storage tank filled with a porous base material and a cylindrical sleeve for attaching the storage tank. To described in more detail, in the cylindrical sleeve, its outside diameter is equal to or larger than that of the storage tank to and serve as a storage tank, the supporting faces between the storage tank and the sleeve is let to become the welding portion; and the welding portion is welded up by a laser welding or resistance welding method.

In order to achieve the above objects, the process for manufacturing a dispenser cathode according to the present invention provides two cathode structures.

First, a cathode structure is provide in which a cylindrical sleeve has an open upper end so as to support a storage tank filled with a porous base material ar press-welded with the storage tank.

Second, a cathode structure is provided in which the cylindrical sleeve and the storage tank are welded through retainer rings.

BRIEF DESCRIPTION OF THE DRAWINGS

The above objects and other advantages of the present invention will become more apparent from the description of the preferred embodiment of the present invention with reference to the attached drawings, in which.

DESCRIPTION OF THE PREFERRED EMBODIMENT

Figure 1:
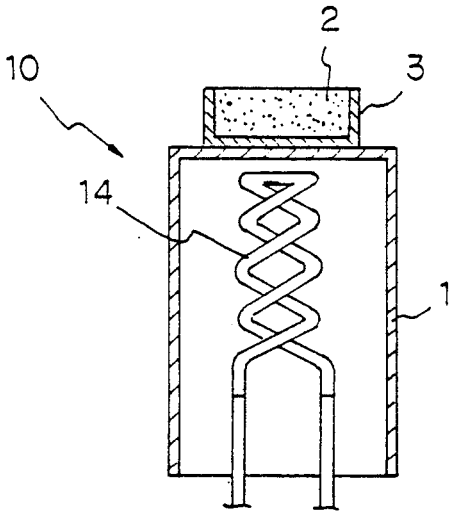
FIG. 1 PRIOR ART
FIG. 1 is a partial cross-sectional view of a conventional dispenser cathode.
Figure 2:
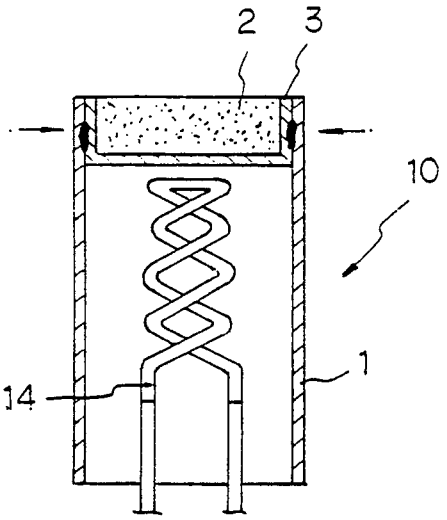
FIG. 2 PRIOR ART
FIG. 2 is a partial cross-sectional view of another conventional dispenser cathode.
Figure 3A:
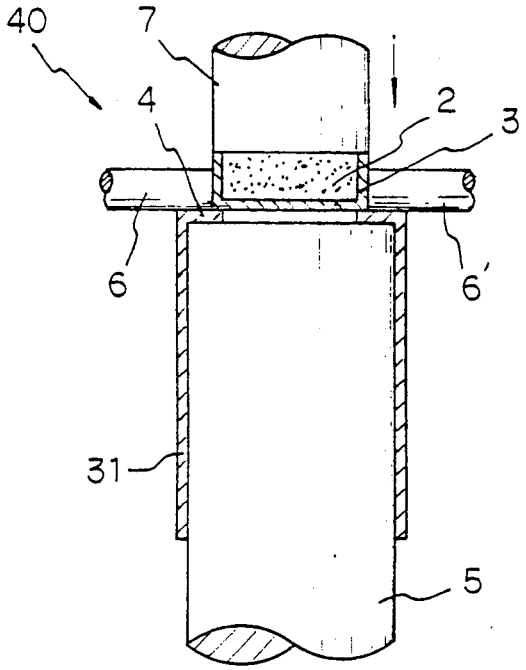
FIG. 3A and 3B are respectively partial sectional views for explaining an embodiment of a process for manufacturing a dispenser cathode according to the present invention.
Figure 3B:
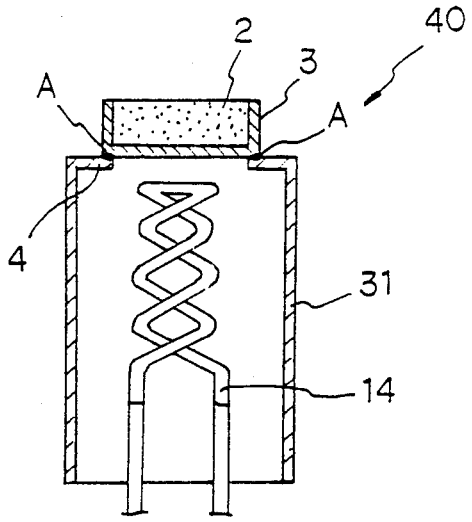

FIG. 3A and 3B are respectively partial cross-sectional views for explaining a process for manufacturing a dispenser cathode according to the present invention. In FIGS. 3A and 3B the cathode structure comprises a storage tank 3 to be filled with porous base material 2, and a cylindrical sleeve 31 having an open upper end of which diameter is smaller than the outside diameter of the storage tank 3 and of which edge serves as a supporting face 4. The supporting face 4 between the storage tank 3 and the cylindrical sleeve 31 is welded to form a cathode structure.

Figure 4A:
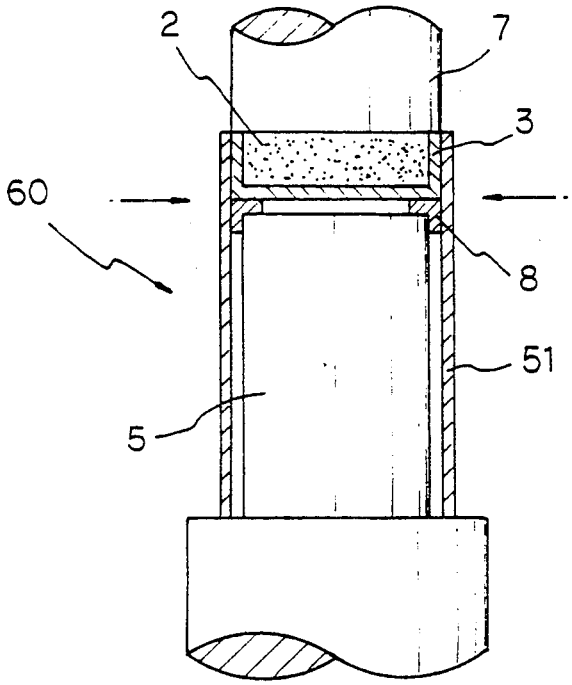
FIGS. 4A and 4B are partial cross-sectional views for explaining another embodiment of a process for manufacturing a dispenser cathode according to the present invention.
Figure 4B:
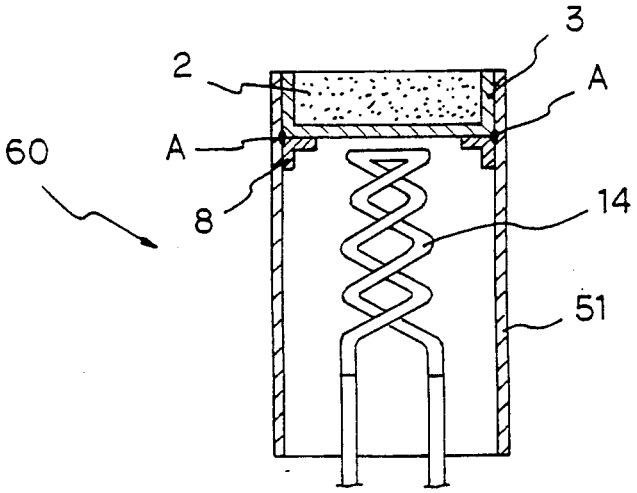

FIG. 4A and 4B are respectively partial cross-sectional views for explaining another embodiment of the process for manufacturing the dispenser cathode according to the present invention. In FIG. 4A and 4B, the cathode structure comprises a storage tank 3 to be filled with a porous base material 2, a cylindrical sleeve 51 having an open upper end, of which diameter is equal to the outside diameter of the storage tank 3, and a retainer ring 8 having the same diameter as the inside diameter of the sleeve 51. The retainer ring 8 is inserted into the sleeve 51, and then, the storage tank 3 is inserted into the sleeve 51 from the top thereof in order to weld the storage tank 3 and the sleeve 51 commonly to the retainer ring 8, thereby forming the cathode structure.

Such dispenser cathodes are formed through three steps of filling the porous base material 2 into the storage tank 3, securing the storage tank 3 which is filled with the porous base material 2 to the cylindrical sleeve 1 by welding, and a installing a heater into the sleeve 1 by applying the usual method.

In the second step, the cylindrical sleeve 31 includes an upper opening in which diameter is smaller than the outside diameter of the storage tank 3 and of which edge portion serve as supporting faces 4, where the outside diameter of the sleeve 31 itself being equal to or larger than the outside diameter of the storage tank 3. The supporting face 4 and the storage tank 3 are welded together by a laser welding or a resistance welding.

Now, the present invention will be described in detail with reference to the embodiments, where the embodiment 1 is in case where the cylindrical sleeve comprises the outside diameter which is larger than that of the storage bank 3, and an upper opening of which diameter is smaller that the outside diameter of the storage tank, and the embodiment 2 is in case where the cylindrical sleeve comprises the inner diameter which is equal to the outside diameter of the storage tank and a retainer ring of which diameter is equal to the inner diameter of the sleeve.

EMBODIMENT 1

FIG. 3 illustrates a part of the dispenser cathode of the first embodiment. First, a first step is performed by filling the porous base material 2 into the storage tank 3. More specifically, a tungsten block having a diameter of 1.4 mm is inserted into the storage tank 3.

Then, in order to sleeve the porous base material 2 to the storage tank 3, a laser welding is performed while pressing down the bottom of the storage tank 3. Then the electron emitting material is mounted upon the porous base material 2, and an impregnation is carried out within a hydrogen furnace, where residue materials remaining on the surface are removed thereupon.

Then in a second step, the storage tank 3 is weld-fixed to a sleeve 31 by a sleeve 1 having an upper circular opening and a supporting face 4. That is, as shown in FIG. 3, a welding supporting rod 5 is inserted into the sleeve 31 and the center of the storage tank 3 and the center of the sleeve 31 are aligned by left and right supporting rods 6,6'. Under this condition, the left and right supporting rod 6,6' are installed on the left and right of the storage tank 3, 1 to keep a manner that the center of the storage tank 3 from being displaced during the welding.

Thereafter, the top of the storage tank 3 is pressed down by means of a pressing welding rod 7, and the storage tank 3 is weld-fixed to the sleeve 1 by the resistance welding. A dispenser cathode 40 thus completed is illustrated in FIG. 3(B), and the supporting face 4 of the sleeve 31 is welded to the bottom of the storage tank 3 to form a portion A.

Then, a third step is carried out for installing a heater 14 into the sleeve 31 by a conventional method.

In the dispenser cathode completed in the above described manner, the porous base material 2 can be prevented from being deteriorated by the heat during the welding, and therefore, the cathode can produce a higher surface temperature compared with the conventional cathode as well as give a stabilized electron emissions.

The dispenser cathode according to the present invention has the characteristics such that the electron emitting material impregnated into the porous base material 2 can be prevented from being evaporated or degraded, since the upper portion of the cathode is opened and the supporting face 4 of the sleeve 31 and the storage tank 3 are welded together.

EMBODIMENT 2

FIGS. 4(A) and 4(B) illustrate another dispenser cathode 60 of the second embodiment of the present invention which is manufactured through the following steps.

That is, a first step is carried out for filling the porous base material 2 into the storage tank 3 in the same way as in the Embodiment 1.

Then, a second step is carried out for securing the storage tank 3 which is filled with the porous base material 2 to the cylindrical sleeve 51 by welding through a retainer ring 8 installed within the interior of the sleeve 51 having an upper opening.

That is, as shown in FIG. 4(A), the retainer ring 8 is installed within the sleeve 51, and then, the storage tank 3 is inserted into the sleeve 51 from the top of the sleeve 51 so as to contact the retainer 8 with the storage tank 3 together. Thereafter, the retainer ring 8 of the interior of the sleeve 51 is fixed by securing the welding supporting rod 5, and then, the surface of the porous base material 2 is pressed by a pressing welding rod 7.

Under such a securing, the laser welding or the resistance welding using the pressing welding rod 7 and the securing welding rod 5 to apply pressure is carried out.

Thus, the sleeve 51, the retainer ring 8 and the storage tank 3 are all welded together, reducing the welded portions as small as the portions round the retainer ring 8 as shown in FIG. 4(B).

The dispenser cathode 60 described as above has advantages such that the welding process is not only simple and convenient, but also the provision of the inner member in the form of the retainer ring 8 intercepts the direct transfer of the welding heat to the porous base material. Therefore, the electron emitting material can be prevented from being evaporated or degraded, thus making it possible to obtain a dispenser cathode 10 having a stabilized characteristic.

Further, since the sleeve, the retainer ring and the storage tank are simultaneously welded, the storage tank 3 can be prevented from displacement from the sleeve 51 due to the strength of the welding portion.

According to the present invention, the storage tank filled with the porous base material is welded to the cylindrical sleeve, the cylindrical sleeve having an outside diameter equal to or larger than that of the storage tank, an upper opening smaller than the outside diameter of the storage tank, and a supporting face provided on the edge of the opening to be welded with the storage tank together. Thus, the heat transfer to the porous base material during the welding is prevented, and therefore, the thermal efficiency can be improved during the operation of the cathode, thus making it possible to obtain a superior cathode characteristic.

Therefore, the impediment of the heat transfer which is the disadvantage of the conventional technique can be overcome, and the evaporation and the degradation of the electron emitting material can be prevented. Further, the surface temperature can be raised over 50° C. compared with the conventional cathodes, thereby improving the quick operation.

Hereinabove, the descriptions were made only on the typical dispenser cathode, but the process of the present invention can be applied to also the storing type and the sintering type and this invention is in no way limited to the embodiments described hereinabove, various modifications of the disclosed embodiment as well as other embodiments of the invention will become apparent to persons skilled in the art upon reference to the description of the invention.

What is claimed is:

1. A process for manufacturing a dispenser cathode comprising the steps of filling a porous base material into a storage tank, welding said storage tank which is filled with said porous base material to a cylindrical sleeve, and installing a heater into said sleeve, the improvement further comprising:

a step of welding a supporting face of said sleeve to said storage tank by a laser welding process or a resistance welding process at welding portions in the step of welding said storage tank, said sleeve having an outside diameter larger than that of said storage tank and an upper opening which is smaller than the outside diameter of said storage tank provided with said supporting face thereabouts.

2. The process for manufacturing a dispenser cathode as claimed in claim 1, wherein said cylindrical sleeve has an outside diameter which is larger than that of said storage tank and an upper opening which is smaller than the outside diameter of said storage tank provided with a supporting face thereabouts.

3. The process as claimed in claim 1, wherein said sleeve has an inner diameter equal to the outside diameter of said storage tank, and a retainer ring is installed within said sleeve for welding said storage tank to said sleeve.

* * * * *